US008770213B2

(12) United States Patent
Downey et al.

(10) Patent No.: US 8,770,213 B2
(45) Date of Patent: Jul. 8, 2014

(54) FLOATING SHADE CANOPY

(76) Inventors: Jeffrey Downey, Apache Junction, AZ (US); Thomas Downey, Gilbert, AZ (US)

( * ) Notice: Subject to any disclaimer, the term of this patent is extended or adjusted under 35 U.S.C. 154(b) by 264 days.

(21) Appl. No.: 13/188,446

(22) Filed: Jul. 21, 2011

(65) Prior Publication Data

US 2012/0017956 A1 Jan. 26, 2012

Related U.S. Application Data

(60) Provisional application No. 61/366,155, filed on Jul. 21, 2010.

(51) Int. Cl.

| | |
|---|---|
| ***E04H 15/02*** | (2006.01) |
| ***E04H 15/32*** | (2006.01) |
| ***E04H 15/58*** | (2006.01) |

(52) U.S. Cl.

CPC ..... *E04H 15/58* (2013.01)
USPC ..... 135/96; 135/120.1

(58) Field of Classification Search

CPC ..... E04H 15/02; E04H 15/32
USPC ..... 135/96, 120.1; 4/499, 503; 441/32, 38, 441/131, 30, 133; 114/345, 346, 361
See application file for complete search history.

(56) References Cited

U.S. PATENT DOCUMENTS

| | | | | |
|---|---|---|---|---|
| 3,367,525 | A * | 2/1968 | Elder | 220/560 |
| 4,571,194 | A * | 2/1986 | Kiss et al. | 441/1 |
| 7,722,419 | B1 * | 5/2010 | Wood | 441/40 |
| 2010/0258153 | A1 * | 10/2010 | Affolter | 135/96 |
| 2012/0060743 | A1 * | 3/2012 | Peters | 114/361 |

* cited by examiner

*Primary Examiner* — David R Dunn
*Assistant Examiner* — Danielle Jackson
(74) *Attorney, Agent, or Firm* — Hartman Titus PLC; Joseph W Mott

(57) ABSTRACT

A floating canopy shade is constructed from a standard fixed or pop-up canopy by adding a set of floats adapted to hold the canopy legs and to provide drag to resist drifting and lifting in a small breeze. A kit converts a standard canopy assembly to a floating one.

1 Claim, 8 Drawing Sheets

FLOATING SHADE CANOPY

CROSS REFERENCE TO RELATED APPLICATIONS

This application claims the benefit of U.S. Provisional Patent Application 61/366,155, filed Jul. 21, 2010.

FIELD OF THE INVENTION

The present invention relates to the field of water recreation, primarily in lakes or possibly in backyard pools.

BACKGROUND OF THE INVENTION

Protection from the sun is desirable, and often necessary, for those engaged in water recreation. Boat canopies provide shade to those aboard, but swimmers, floaters, or those standing in shallow water would benefit from a canopy shading them as well. Standard pop-up canopies, sized between 6'×6' (2 meters square) and 12'×12' (4 meters square) are available, but these are designed to sit on the ground.

The present invention provides a way to float a pop-up canopy, or any lightweight canopy with legs, on the surface of the water in a stable configuration.

DETAILED DESCRIPTION

Figure 1:
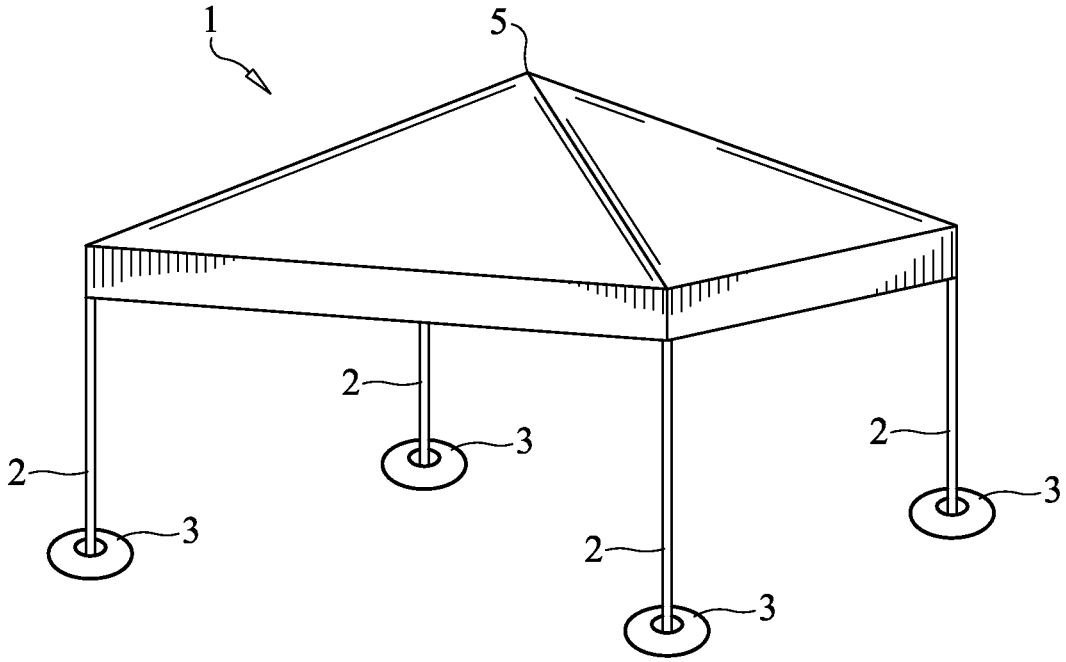
FIG. 1 shows a canopy floating on the water in accordance with one embodiment of the invention.

Shade canopies are generally available for camping, boating, picnicking and other recreational activities. A common design is as seen in FIG. 1. Canopy (1) includes a fabric cover, a collapsible frame (not shown) to support the cover, rising to a central peak (5) and a plurality of legs (2) attached to the frame. The fabric cover is often made of canvas or one of a variety of polyvinyl materials. Commercially available collapsible or pop-up canopies are sold in a variety of sizes and shapes, with the most popular being a square frame about 6 feet on each side to about 12 feet on each side, with four supporting legs attached to the frame.

Figure 3:
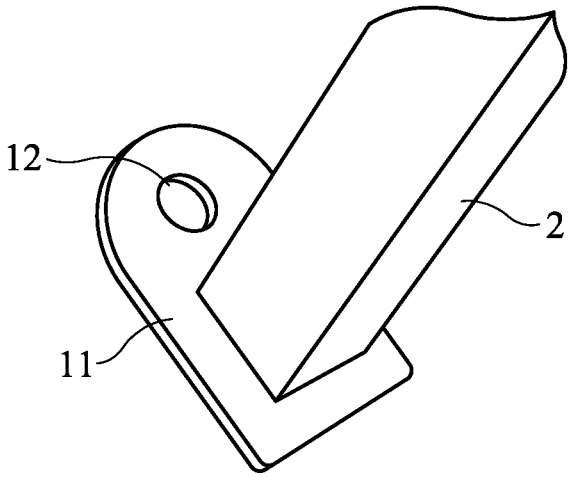
FIG. 3 illustrates a typical canopy leg with a single hole.
Figure 4:
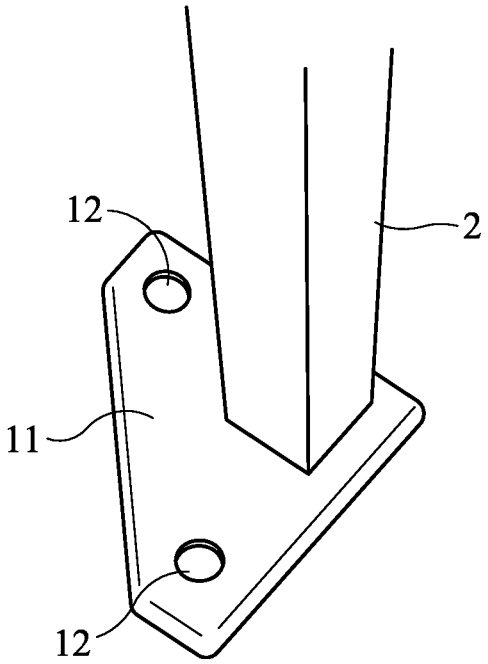
FIG. 4 illustrates a typical canopy leg with two holes.

Collapsible canopies commonly include a component to facilitate staking the canopy to the ground. As illustrated in FIGS. 3 and 4, the distal end of a canopy leg (2) includes a foot (11), usually a plate affixed to the leg, with one or two holes (12) for insertion of a ground stake or tying to a ground stake. An embodiment of the current invention makes use of the foot and hole(s) to attach the leg to a float. See FIG. 5.

Figure 2:
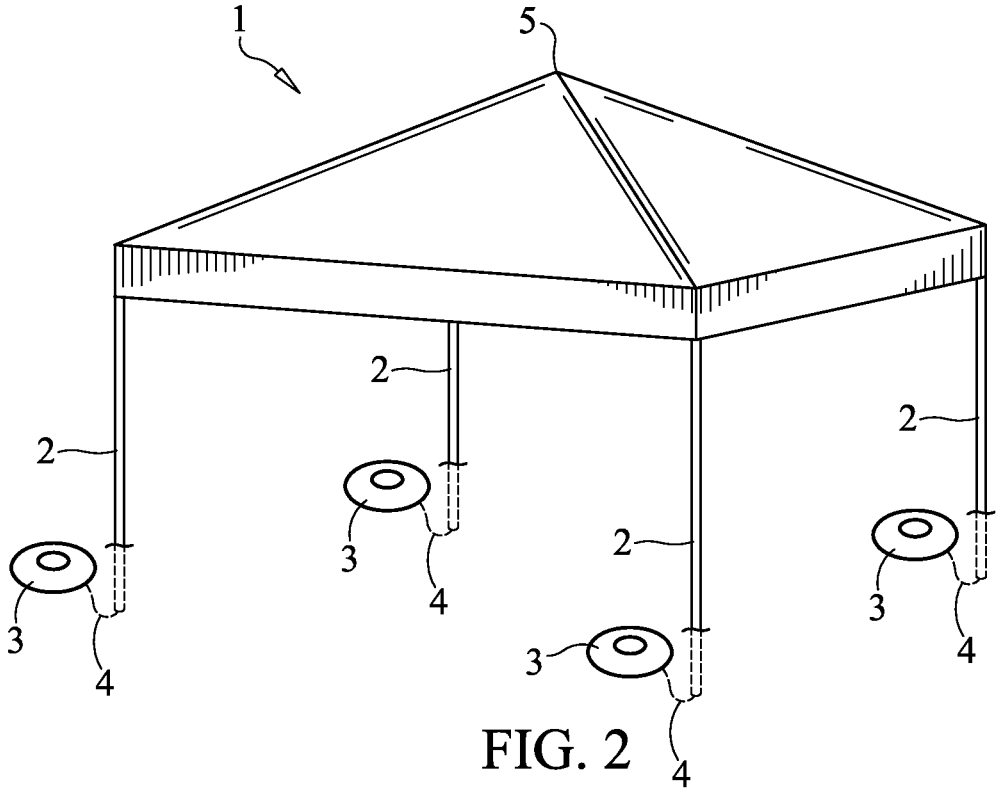
FIG. 2 shows a canopy floating on the water in a different embodiment of the invention.

FIG. 2 illustrates one embodiment, in which each leg (2) is attached to the underside of a float (3) by a tie line (4). The tie line (4) may be of any suitable length, and an advantageous embodiment uses tie lines about 24 inches (60 cm) long. For a canopy with 6 foot (2 meter) legs, this configuration allows the canopy to float stably about 4 feet (1.2 meters) above the water, providing adequate shade to swimmers or waders.

Figure 6:
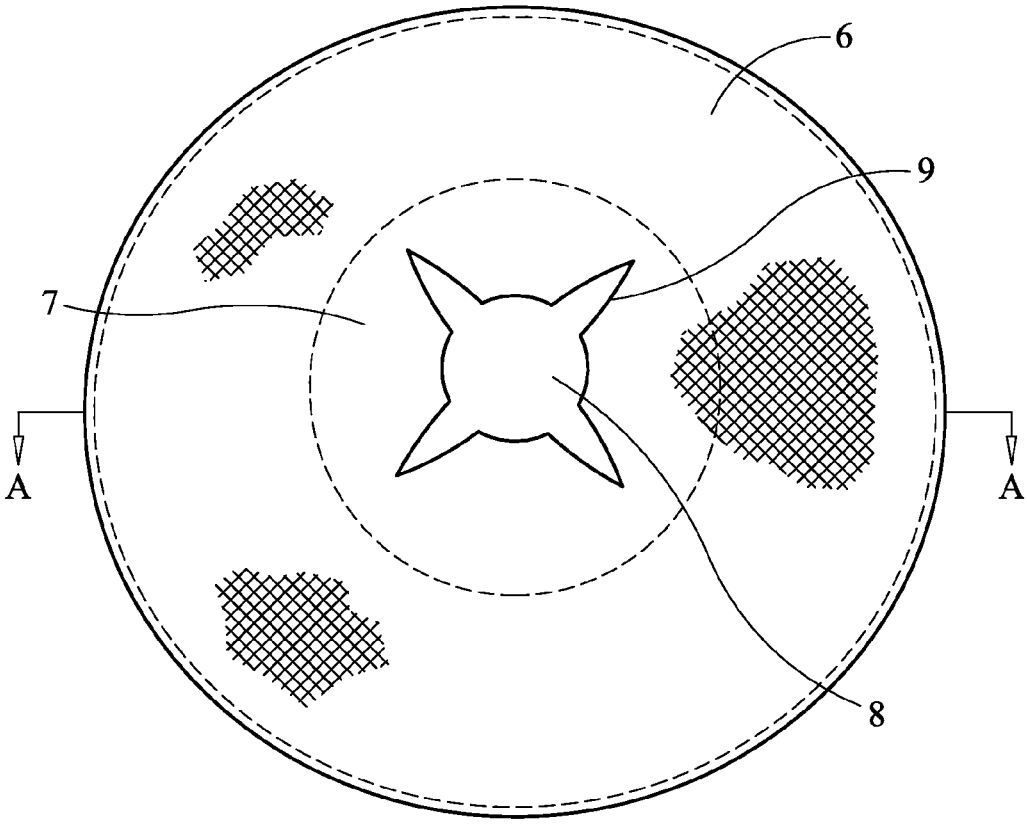
FIG. 6 shows a top view of a float having a mesh envelope surrounding a flotation element.
Figure 7:
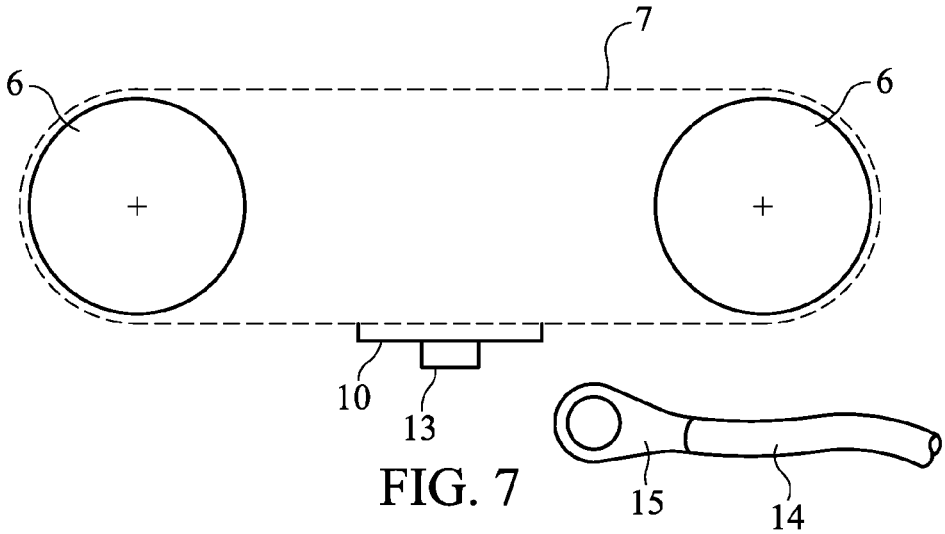
FIG. 7 shows a cross section of the float of FIG. 6.
Figure 8:
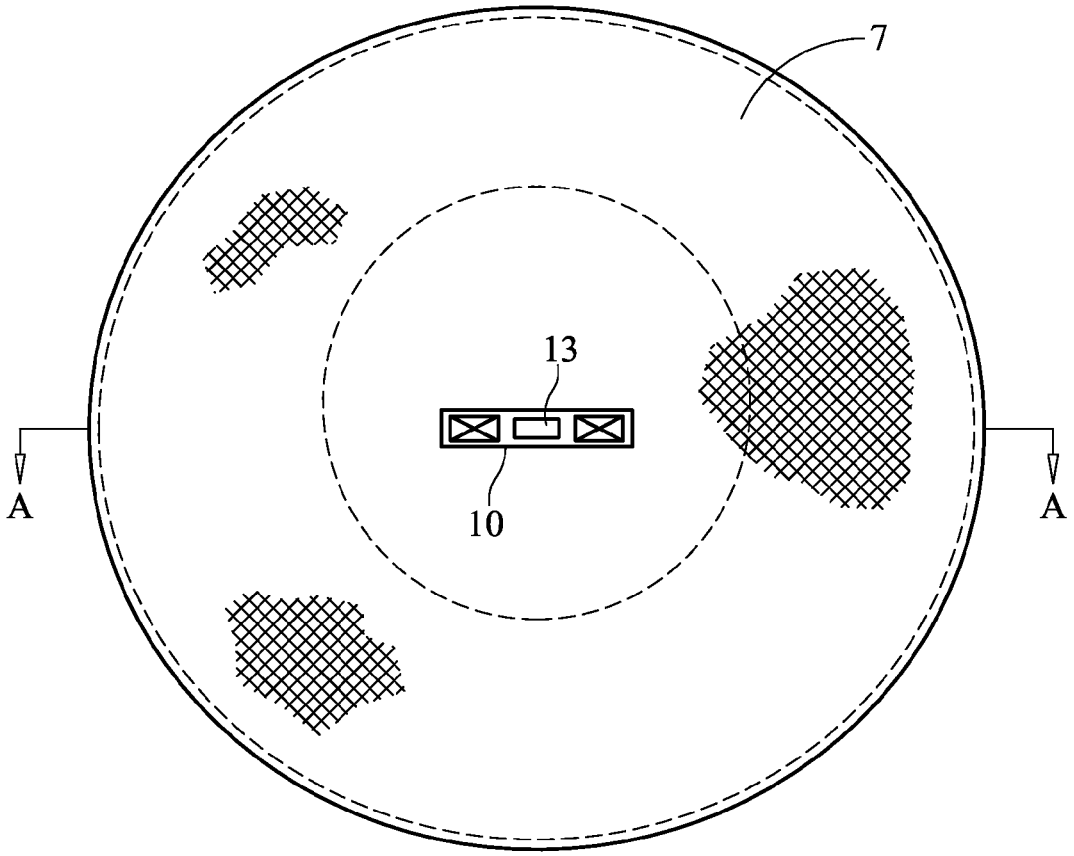
FIG. 8 shows a bottom view of the float of FIG. 6.

One version of the float is shown in FIGS. 6 to 8. A flotation element (6) is encased in an envelope (7). A convenient flotation element is a toroidal air-filled tube, such as the inner tube for a golf cart tire. The inner tube may be easily deflated for storage and inflated for use. As shown in FIG. 6, the flotation element (6) is surrounded by a fabric envelope (7). The envelope may be any suitably durable and flexible material, taking into consideration the sun and water environment in which it will be used. For example, high-density woven polypropylene mesh, used in many commercial tarp applications, is an option. A material used successfully in experimentation is a strong vinyl-coated polyester woven mesh sold by Phifer Corporation as SunTex® for exterior shade screening applications. Non-mesh canvas or tarp fabrics may also be used.

In an embodiment, the top portion of the envelope may include an opening (8) with a plurality of radial slits (9) to facilitate insertion of an inflatable tube, in its un-inflated state, into the envelope. The opening also affords access to a valve for inflation. In an embodiment, a reinforcing strap (10) with an attachment base (13), such as a ring, a tab or a loop, may be affixed to the underside of the float envelope (7) by stitching or other suitable method. As alternatives to an inner tube, the flotation element (6) may be any of a variety of known flotation devices, including, for example toroids, blocks or multiple balls that may be hollow plastic or made of suitable grades of polyurethane, polystyrene, polyethylene or styrofoam, or other natural or synthetic buoyant materials.

Figure 13:
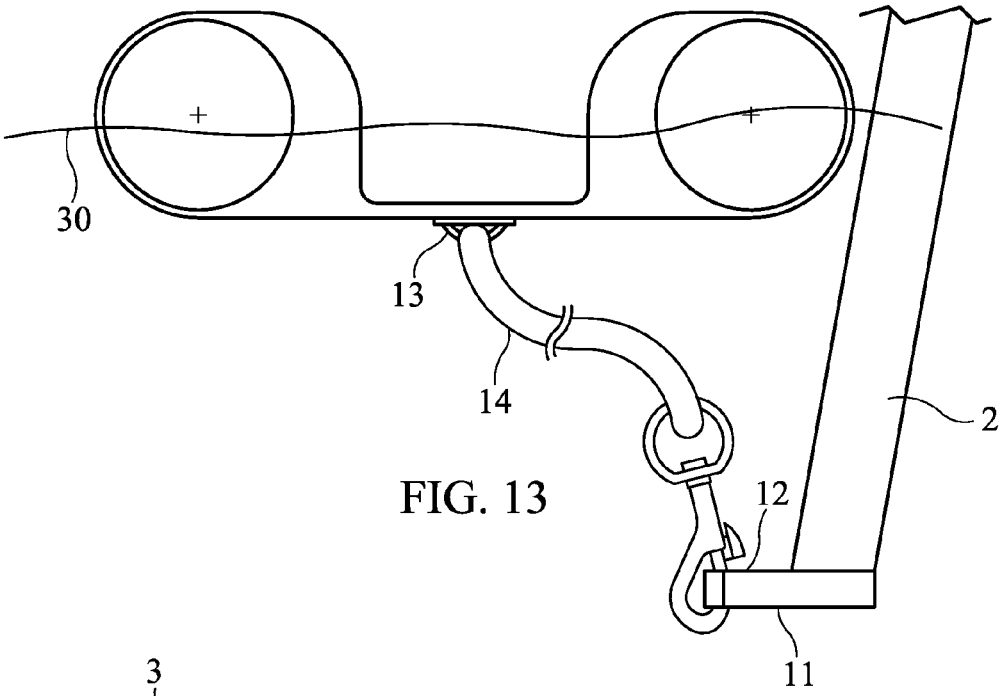
FIG. 13 is a depiction of a cross section of a float with a canopy leg attached below the float.
Figure 14:
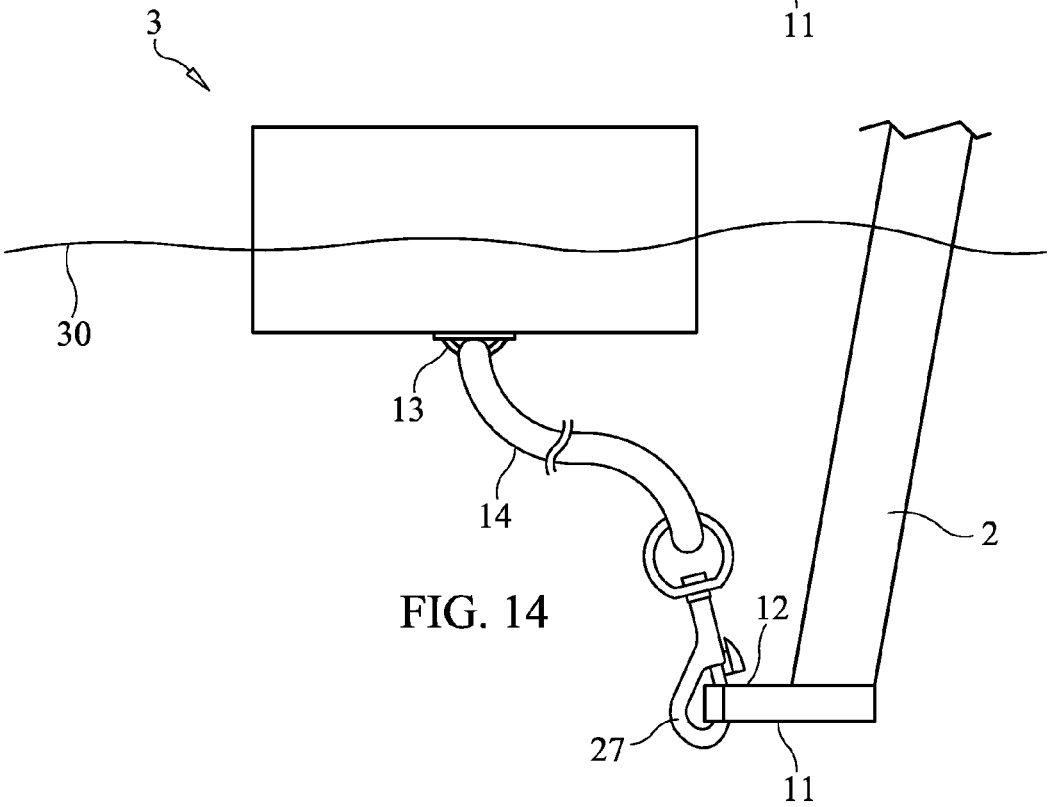
FIG. 14 is a depiction of a cross section of an alternative form of float with a canopy leg attached below the float.

The canopy leg is attached to the float by a tie line (14) shown in FIG. 7. The tie line (14) may be a rope, a lanyard, a flexible cable, a chain, or any other line that is flexible and suitable for use in the water. As noted previously, the line may advantageously be about 2 feet long in some applications. The length of the line may be adjusted to suit the dimensions of the canopy and the desired height above the water. The tie line (14) has an attachment clip (15) which may be any appropriate connector compatible with the attachment base (13). In some embodiments, a spring clip, a D-ring or a carabiner clip would be used for easy attachment and detachment. The tie line is attached to the foot (11) of the leg (2) as shown in FIGS. 13 and 14. An appropriate attachment clip (27) is used to secure the line to the leg. The illustrated embodiment shows an attachment that takes advantage of the foot and staking hole present in commercially available pop up canopies, but other known methods to releasably attach the line to the leg may be used.

In another embodiment, shown in FIG. 14, the float does not include a fabric envelope. Float (3) comprises a flotation block of appropriate buoyancy, and may be any buoyant material, from air-filled chambers to natural floats such as wood or cork, to synthetic materials or foams. Tie line (14) is attached to an attachment base (13), which may be a ring, tab or other appropriate shape affixed to the underside of the float (3).

Attachment may be by an attachment clip such as the clip (15) in FIG. 7. The other end of the tie line (14) is attached to the canopy leg (2).

In operation, the flotation system provides good stability for a floating canopy under light breeze conditions. Under most conditions, an anchor (not shown) of appropriate weight and shape will stabilize the lateral drift of the canopy. The preferred configuration would be to attach the anchor rope to the canopy frame at the center peak (5). When a breeze pushes against the canopy, the central anchor causes the force to induce rotational motion around the anchor. As the frame begins to rotate, each float (3) is pulled behind the moving leg to which it is attached, acting as a sea anchor and supplying drag to resist and retard the motion. Additionally, if a breeze applies lift to one side of the canopy, the rising legs on that side pull against the floats, again causing a drag that retards the motion.

Figure 5:
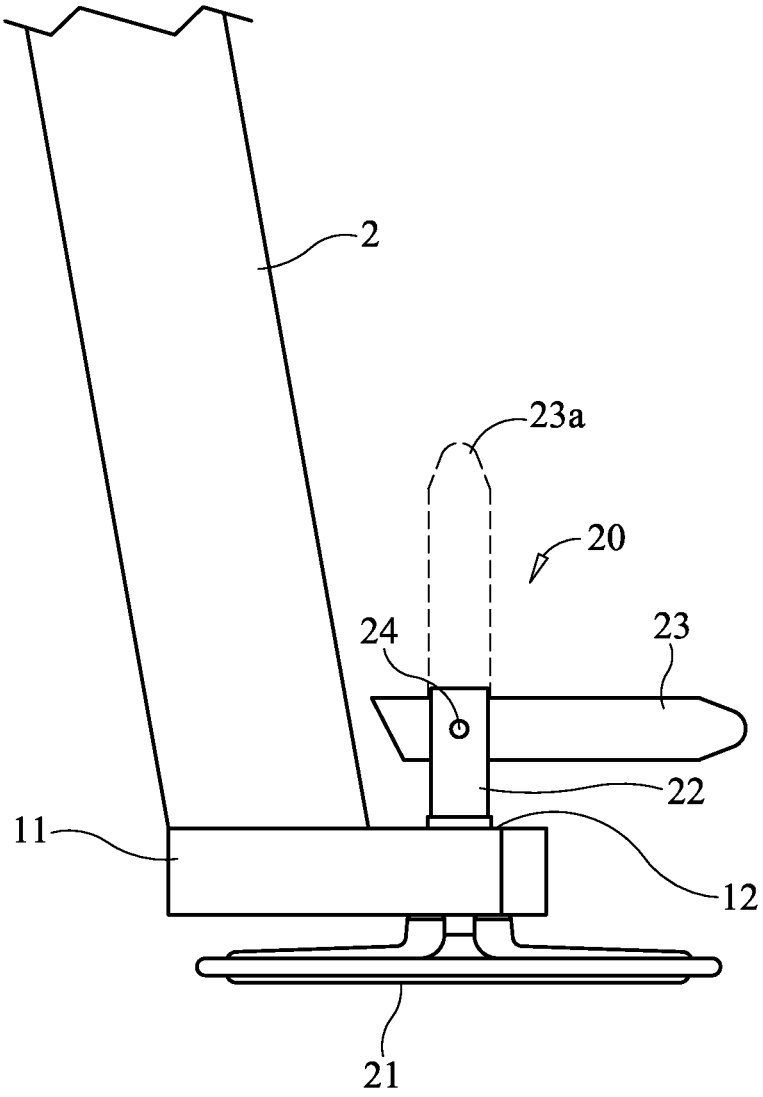
FIG. 5 shows a leg retainer in an embodiment of the invention.
Figure 9:
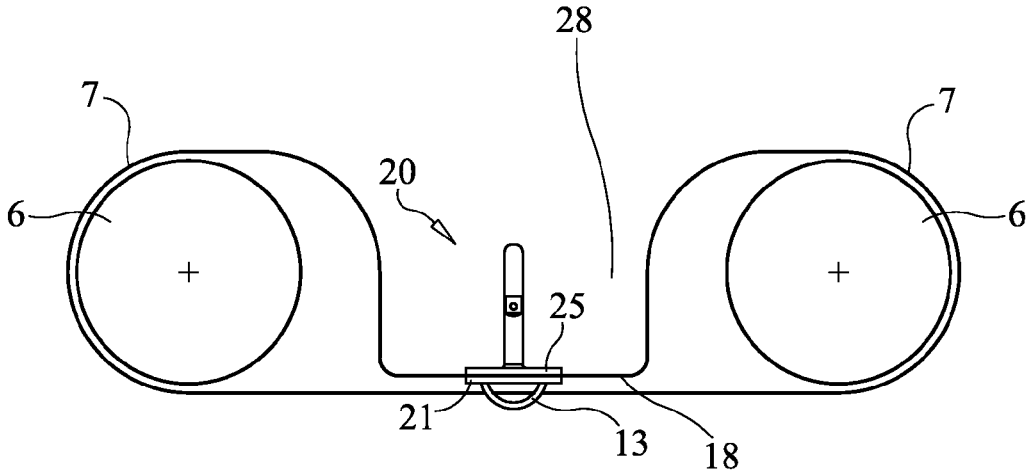
FIG. 9 shows a cross sectional view of a float having a mesh cover over the flotation element.

Another embodiment of the flotation system is shown in FIGS. 9-12. In one version, envelope (7) is configured to define a central basin (28) surrounded by the toroidal flotation tube (6) and having a basin floor (18). The envelope may be of the same mesh materials discussed above. The fabric should allow water to pass through. In this embodiment, the canopy leg sits atop the float rather than being suspended under it by a line. One leg retainer (20) for attachment of the leg is shown in FIG. 5. A quick release latch comprises a base (21) that is attachable to the basin floor (18) of the float (3), a support arm (22) rising vertically from the base (21) and a latch arm (23) that pivots on pin (24). When the latch arm is in vertical position (23*a*) it will pass through hole (12) in foot (11) of canopy leg (2). The latch arm (23) is then turned horizontal, where a détente (not shown) holds it in place and secures the foot (11) and canopy leg (2). Base (21) may be affixed to the basin floor (18) by a cap plate (25) or any other conventional manner. In one embodiment, as illustrated in FIG. 9, the leg retainer (20) is combined with an attachment base (13) that protrudes from the bottom of the float (3) making the float useable for a canopy sitting atop the float or suspended by a line below the float.

Figure 10:
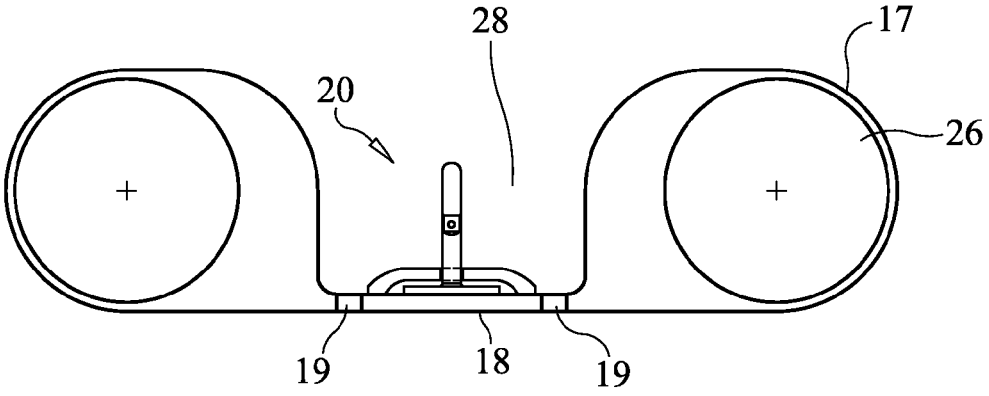
FIG. 10 shows a float having a solid cover over the flotation element.
Figure 11:
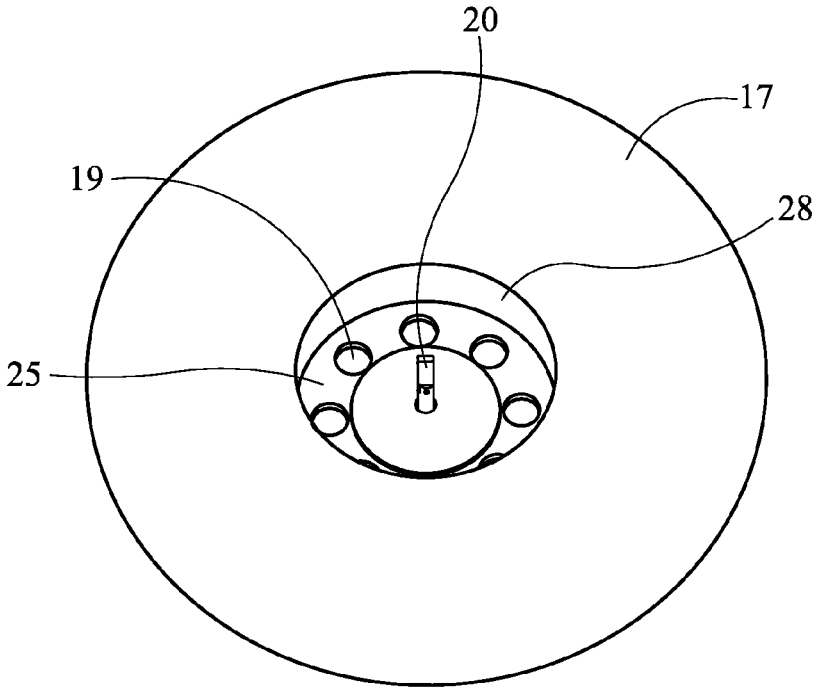
FIG. 11 is a top perspective view of a float having a solid cover over the flotation element.

In another embodiment, illustrated in FIGS. 10 and 11, the float has a water-impermeable skin, which may be a water-tight fabric or another material, such as synthetic rubber, plastic or other lightweight waterproof material. Outer skin (17) defines a surrounding wall portion and a basin (28). This may be a plastic donut shape with air entrapped in the circular tube, or there may be flotation material inside. In this configuration, a leg retainer is affixed to the basin floor so the leg may be attached on top of the float. Alternately, an attachment base (13) may be added under the bottom of the float. When the skin is water impermeable, a plurality of holes (19) should be placed in the basin floor so water may enter the basin from below. While the donut shape for a float is very efficient, it is not the only useful configuration. A square or other multilateral general shape could be implemented.

Figure 12:
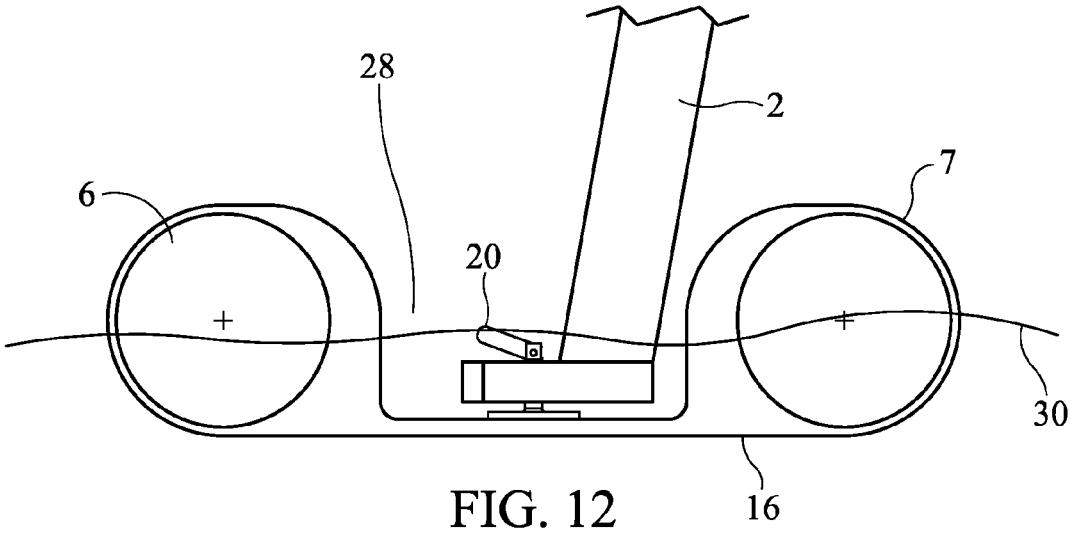
FIG. 12 is a depiction of a cross section of a float with a canopy leg attached.

The buoyancy of the floats (3) will be affected by the materials used (inner tube in a fabric envelope, flotation foam in plastic housing, hollow plastic donut, etc.) and by the load applied (weight of the canopy as distributed on the legs). For effective operation, materials should be selected so that the loaded buoyancy of the set of floats is such that the floats sit partially under the water surface. For floats with a basin (28), the basin should be about half filled with water during stable operation, as shown in FIGS. 12 and 13. Under these conditions, the partially submerged float will act as a sea anchor to resist rotation of the canopy in a breeze, and the water in the basin will provide a resistance to lifting as it seeps out through the mesh or bottom holes.

The foregoing description has been presented and is intended for the purposes of illustration and description. It is not intended to be exhaustive nor limit the invention to the precise form disclosed and many modifications and variations are possible in the light of the above teachings. The embodiments were chosen and described in order to best explain the principles of the invention and its practical application and to enable others skilled in the art to best utilize the invention in various embodiments and with various modifications as are suited to the particular use contemplated. Therefore, it is intended that the invention not be limited to the particular embodiments disclosed for carrying out the invention.

What is claimed is:

1. A floating shade canopy comprising a fabric canopy assembly including a fabric cover on a supporting frame having a plurality of downwardly extending legs, each leg having a lower extremity;

a plurality of flotation devices for supporting a load comprising the canopy assembly, each comprising a surrounding buoyant wall defining a central basin with a water permeable floor, the floor having top and bottom sides; and a leg retainer on the top side of the floor adapted to hold the associated leg;

wherein the buoyancy of the flotation devices is such that when loaded with the canopy assembly they float partially submerged with the supported load partially submerged and the basin about half filled with water that has entered through the floor;

wherein the leg retainer comprises a base attached to the basin floor, a vertical arm attached to the base and a latch arm pivoting on a pin wherein the latch arm shifts from a vertical position to a horizontal position.

* * * * *